United States Patent [19]

Bassett

[11] Patent Number: 4,953,489

[45] Date of Patent: Sep. 4, 1990

[54] TRIRADIAL SAIL PANEL CONFIGURATION WITHOUT BIAS EDGES

[76] Inventor: Clarke C. Bassett, 84 Waterside La., Cottage #1, Clinton, Conn. 06413

[21] Appl. No.: 379,428

[22] Filed: Jul. 13, 1989

[51] Int. Cl.[5] ..... B63H 9/04

[52] U.S. Cl. ..... 114/103

[58] Field of Search ..... 114/39.1, 102, 103, 114/111, 114, 115

[56] References Cited

U.S. PATENT DOCUMENTS

| | | | |
|---|---|---|---|
| 2,796,038 | 12/1954 | Pegel et al. . | |
| 3,274,968 | 9/1964 | Haynes et al. . | |
| 3,356,059 | 11/1966 | Ross . | |
| 3,680,519 | 8/1972 | Jalbert | 114/103 |
| 3,828,711 | 8/1974 | Russell . | |
| 3,954,076 | 5/1976 | Fracker . | |
| 4,593,639 | 6/1986 | Conrad . | |
| 4,624,205 | 11/1986 | Conrad . | |
| 4,702,190 | 10/1987 | Conrad . | |
| 4,708,080 | 11/1987 | Conrad | 114/103 |
| 4,815,409 | 5/1989 | Conrad . | |

OTHER PUBLICATIONS

Bainbridge Advertisement Photographs, Sailing World Publication.

*Primary Examiner*—Sherman D. Basinger
*Assistant Examiner*—Stephen P. Avila
*Attorney, Agent, or Firm*—Nolte, Nolte and Hunter

[57] ABSTRACT

A sail comprises a number of pluralities of radial panels. Each panel comprises a pair of lengthwise parallel edges. Each of the pluralities is oriented to radiate from a corner of the sail. The panels of each plurality are oriented and angled to each other to converge near the corners, to overlap more of each other near the corners, to diverge away from the corners and to overlap less of each other away from the corners.

11 Claims, 4 Drawing Sheets

TRIRADIAL SAIL PANEL CONFIGURATION WITHOUT BIAS EDGES

FIELD OF THE INVENTION

The present invention generally relates to a sail design, and more particularly sails used for both recreational and professional sailing vessels. The invention promotes durability and shaping consistent to original design. The invention efficiently transfers the pressure of the wind and the air pressure generated from the vessels forward movement through the water, to the corners where the sail is supported by the structures of the vessel. The resulting shape of the foil is retained from the originally constructed shape, with a minimum of distortion of the fabric due to the loads generated by the air pressure on the sail.

BACKGROUND OF INVENTION

Different sail designs are numerous and characteristic of sail manufacturers with the purpose of reducing and controlling sail distortion. These sails are used on both recreational and professional sailing vessels. However, the prior art does not include this particular type of panel configuration.

SUMMARY OF INVENTION

An object of the present invention is to provide a sail design that minimizes the load distortion of fabric for the purpose of retaining an efficient shape. The invention conforms to an effective lifting surface which propels the vessel to the sails' greatest potential. The panel configuration of the invention is oriented to reduce the stretch of the overall fabric of the sail and translate the load from the body of the sail to its' corners and attached edges. Overlaid geometric shapes, mainly parallelograms, are concentrated in areas of higher load, then overlaid less as the overall fabric reaches the areas of least loading.

Another object of the invention is to provide the panel configuration to be oriented along the paths of stress in the sail, so as to reduce the amount of distortion from said stress. The panel configuration of the invention is derived from the inherent nature of gradually reducing the overlaid layers from the corners of the sail into the body of the sail.

A further object of the invention is to allow an infinite number of variations in the load carrying potential of the overall fabric of the sail. By overlaying the fabric with greater intensity, the present invention allows for more control of fabric distortion.

Still another object of the invention is to provide ease of manufacture while offering little in waste or cloth which is termed unusable in the sail's further construction. Each panel is precut and prepared for assembly before the assembly occurs. The geometric shapes lend themselves to manufacture from bolts of conventional fabric. The panels are overlaid in assembly to provide for the sails' designed load carrying characteristics. The final point of this object is: the assembled sail is unique to its needs and is not dependent upon the load carrying characteristics of the original bolt of fabric.

ADVANTAGES

The sail design of the present invention utilizes a unique panel orientation that lends itself to the solutions of; (a) the load carrying potential of the sail's fabric. (b) the ability of the paths to inherently follow the load paths of the sail. (c) the ability to use conventionally woven fabric to its maximum load carrying potential. (d) to offer an ease of assembly not yet offered with previous designs.

A. An increase in flexibility to the load carrying potential of the sail's fabric. The geometrically shaped panels can be arranged by overlaying to a greater or lesser degree, offering to the finished sail an increase in the load carrying potential.

B. By the nature of the sails' construction, that is being made from geometric shapes (mostly parallelograms) lends itself to the orientation of the panels following the load path of the sail. The nature of construction is one where the panels are overlaid at the corners the greatest amount and then as the panels radiate into the middle the overlap decreases.

C. The ability to use conventionally woven fabric to its maximum load carrying potential. Conventional fabric is comprised of weaving warp and fill yarns together. Typically heretofor sailmakers have constructed the panels from conventional fabric by cutting triangular shapes from the standard rectangular bolts of fabric. This necessitates that a bias or diagonal cut be made across both the fill and warp yarns. This method weakens the load carrying potential of that panel. The present invention uses panels which have parallel sides which when cut from a rectangular bolt of fabric, preserves the warp and fill yarn integrity, thus creating a stronger panel than was previously done.

D. The present invention offers an ease of assembly. Once the panels are taped with adhesive and arranged into the configuration of the design or model. Assembly requires only adhering one panel to the next. From this point regular sailmaking procedures are used.

These together with other objects and advantages which will become subsequently apparent, reside in the details of construction and operation as more fully hereinafter described and claimed, reference being had to the accompanying drawings forming part hereof, wherein like numerals refer to like parts throughout.

BRIEF DESCRIPTION OF THE DRAWINGS

The accompanying drawings of the invention do not embody all types of sail which a vessel may set. These drawings demonstrate only three types of sails a vessel may carry; a mainsail, a genoa or jib, and a spinniker. There may be other applications of sail types to which this invention applies.

DETAILED DESCRIPTION OF THE DRAWINGS

Figure 1:
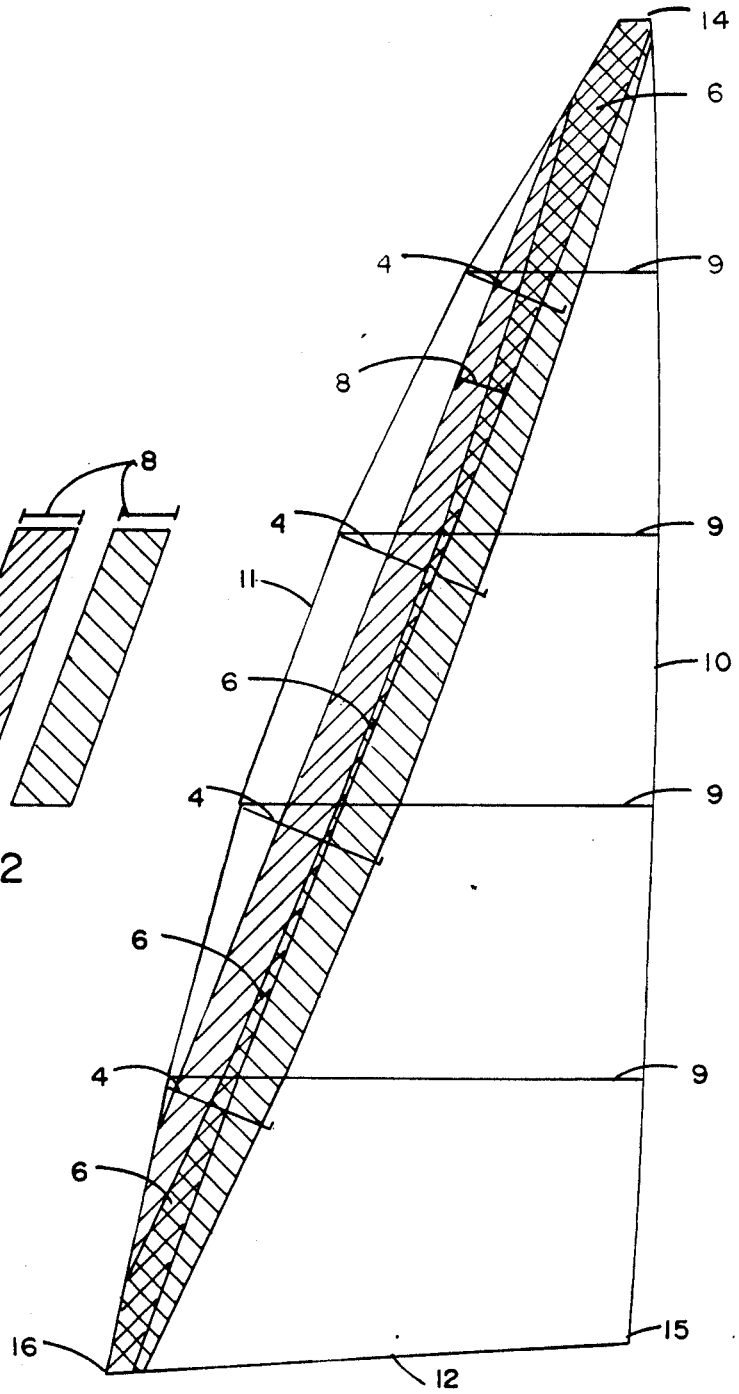
FIG. 1 is a frontal elevation of a single overlay in a mainsail profile. The figure is meant to clarify the complexity of the following figures by demonstrating a single vertical section of the whole.

The present invention derives the panel orientation from both design and construction techniques. Referring to FIG. 1, the preferred embodiment is as follows: A drawing or modeled representation is made outlining the edges ie. the luff 10, the leech 11 and the foot 12, and corners ie. the head 14, the tack 15 and the clew 16 of the sail's exterior perimeters. For construction purposes other conventional means of support i.e. battens, may be added to the drawing 4. The drawing is then divided into sections 9 in which the panel 1 orientation's angle may be changed from the preceding section and shaping may be added. The widths of the panels 8 and the amount of overlap 6 are then decided from the design which conforms to the direction and amount of stress on the fabric.

Figure 2:
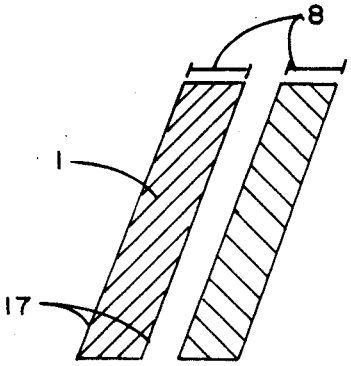
FIG. 2 is an abstract of two panels within a section.

Referring to FIG. 2 in which two panels 1 are abstracted from FIG. 1 in order to demonstrate the panel width 8 having parallel edges 17. The panels 1 when overlaid upon each other from an overlap 6.

Figures 3, 4:
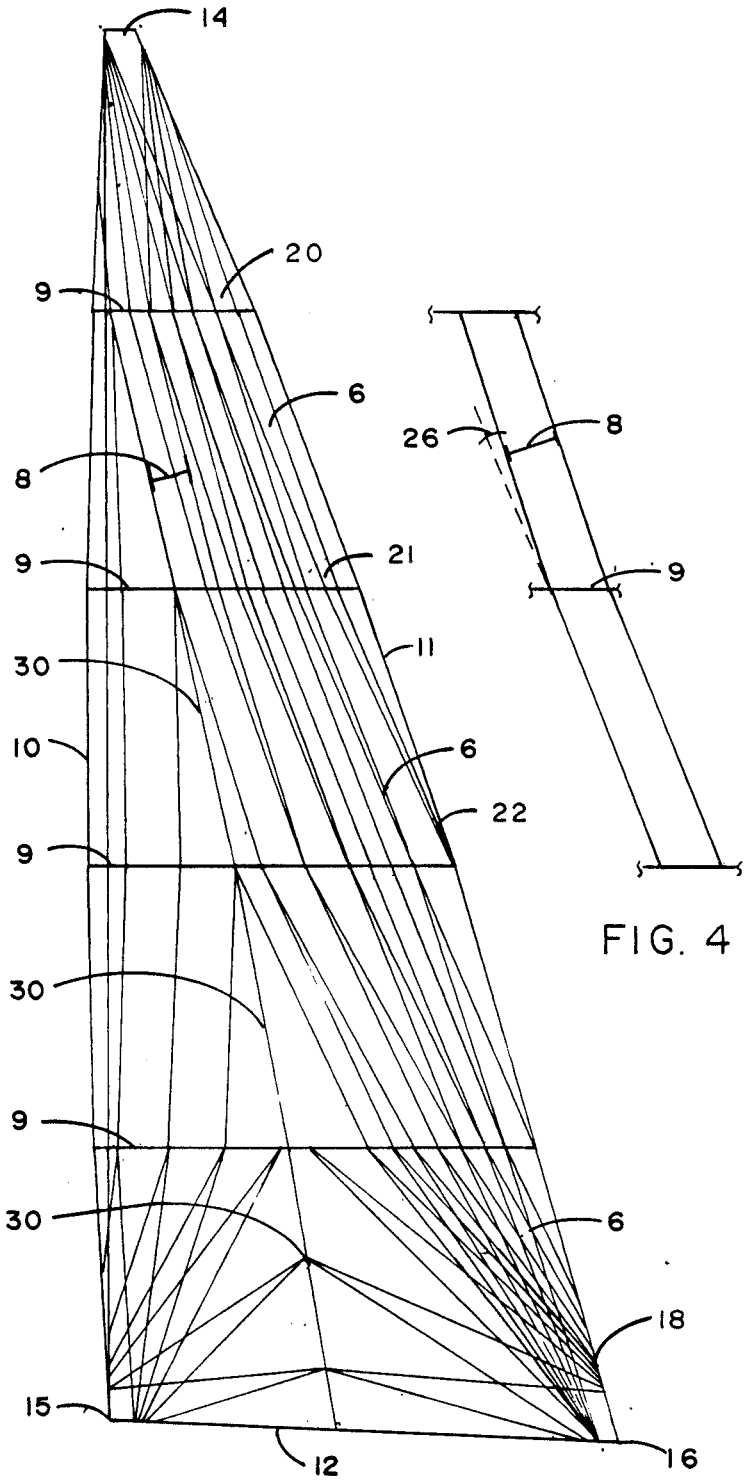
FIG. 3 is a total frontal elevation of a mainsail type sail. The figure offers a visual representation of the panel orientation in a full configuration.
FIG. 4 is an abstract of a joint panel configuration removed from two sections.

The overall panel orientation is most clearly shown in FIG. 3 where the pluralities of radial panels 1 are seen to converge in the head 14, tack 15 and clew 16 areas. Each panel which is comprised of parallel edges is shown as lines 16 within the exterior perimeters of the sail 10, 11, 12 excluding those edges needed for construction purposes 18. The orientation of panels 1 is such that the panels converge in corner areas 14 15 16, and diverge away from said corner areas in sections 20, 21, 22.

All the edges of the panels 25 within their respective sections 9 as seen in FIGS. 1, 3, 5, 6 are parallel, and are said to be longitudinal edges free of the bias direction of the initial bolt of sailcloth except where panels coincide with the perimeter 10, 11, 12 and at a low stress miter 30. The panel orientation changes between sections 9 are represented by a difference in angle 26 between sections 9 as seen in FIG. 4. The sections 9 are joined by conventional sailmaking means with adhesive.

Figure 5:
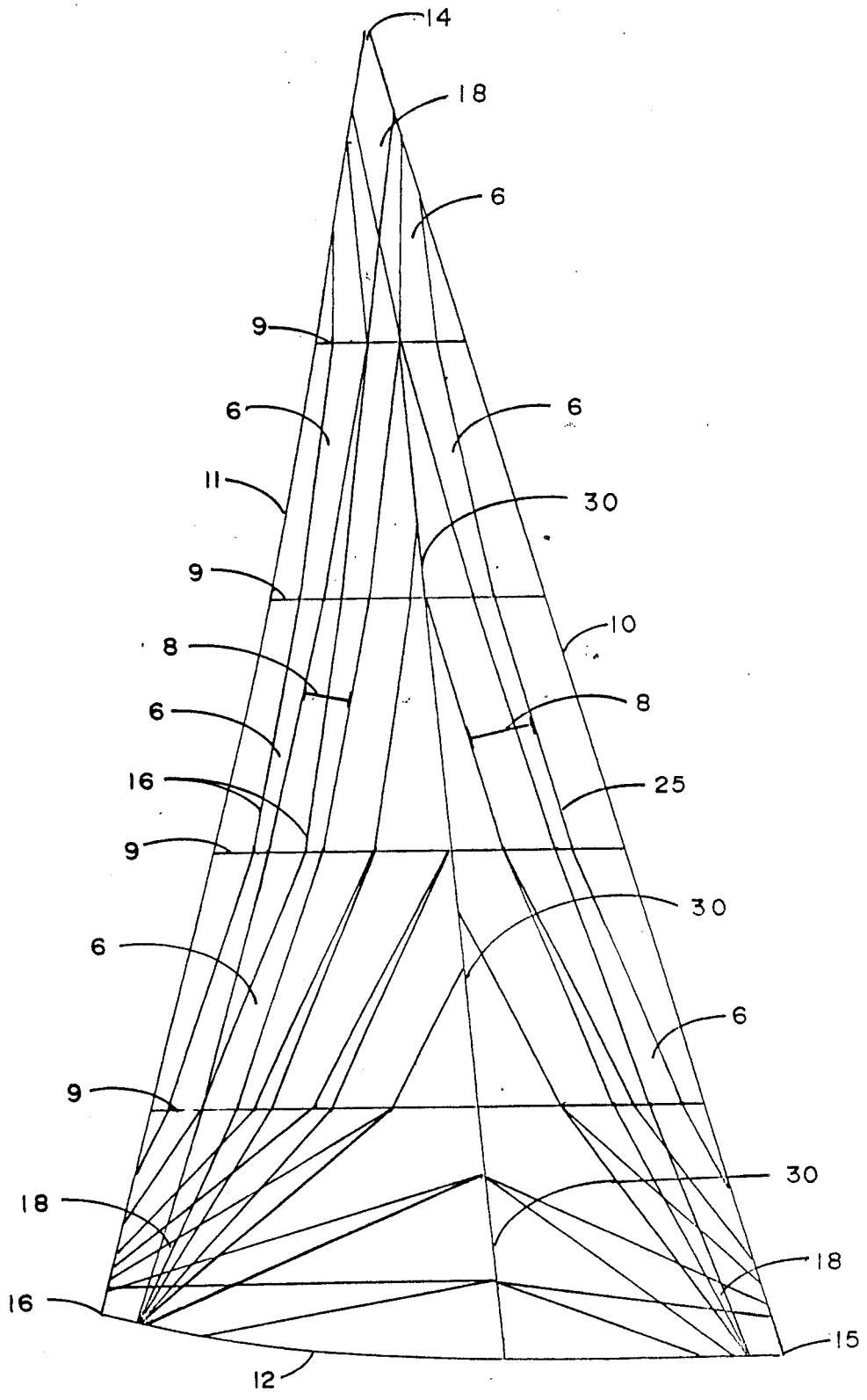
FIG. 5 is a frontal elevation of a genoa or jib in the full configuration of panel orientation.
Figure 6:
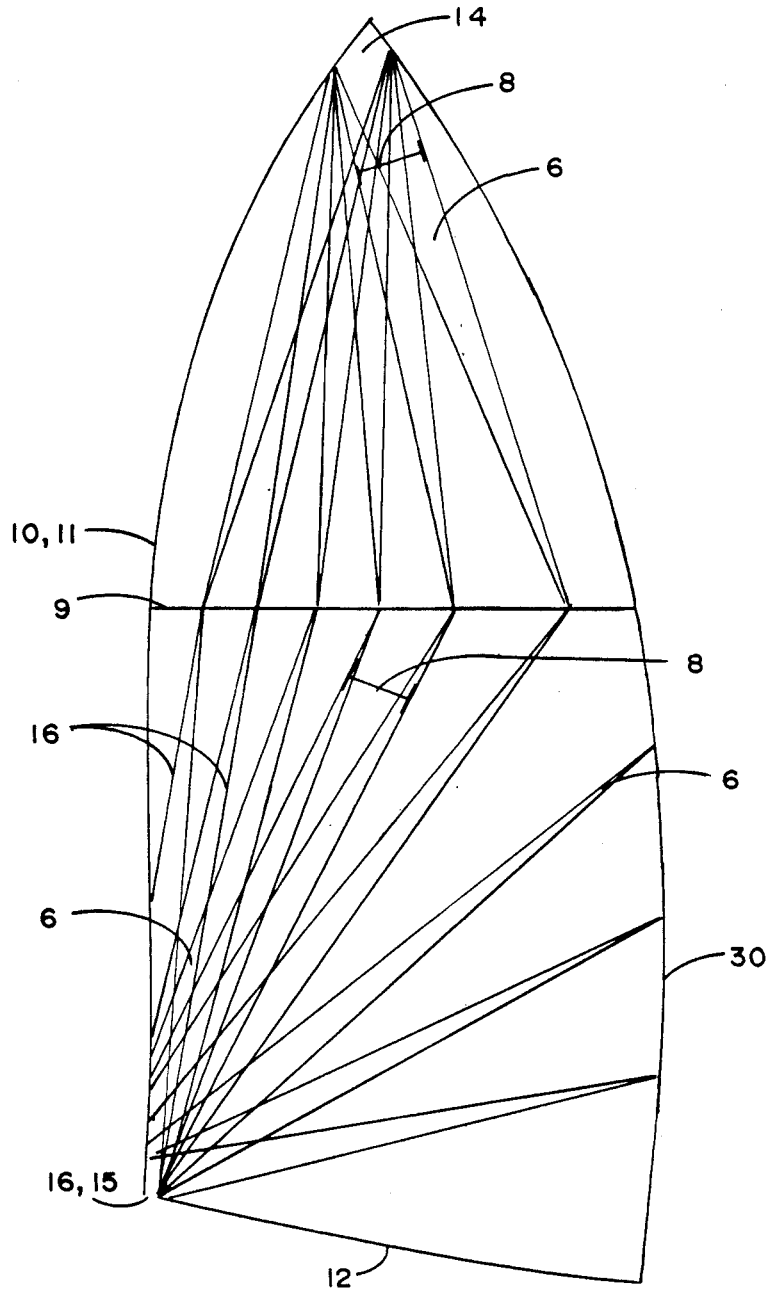
FIG. 6 is a frontal elevation half section of a spinniker in the full configuration of panel orientation.

Similar principles apply to other types of sails for a sailing vessel; FIG. 5 a frontal elevation of a headsail, and FIG. 6, a frontal half section of a spinniker. Referring to FIG. 6 the drawing is represented in half section, that is half of the full configuration, where the luff 10 and leech 11 are drawn upon each other. The central miter 30 is shown on the edge of the drawing and is represented as the vertical middle of the sail when in full frontal configuration. Convention dictates the spinniker to be drawn this way as both sides are redundant.

With the drawing complete the construction methods are as follows. Starting from the corners of the sail 14, 15, 16, the panels 1 are overlaid 6 on each other in the most effective way to accommodate the higher stresses on the fabric. As the panels 1 radiate into the body of the sail, the overlay is decreased as a function of the decreasing stresses on the fabric due to the aerodynamic pressures on the sail.

The panels 1 are cut from bolts of fabric which may vary in weight and load carrying characteristics as the stresses on the sail demand. A method of compilation is used to determine the most efficient manner from which the panels may be cut from bolts of fabric. This methods arranges the geometric shapes so as to butt one another with as little wasted fabric as possible. The panels are further prepared for assembly by placing an adhesive strip of tape along the edges of the panel 1 to facilitate the proper alignment of panels with respect to another before sewing together.

At this point a section at a time is assembled in accordance with the previously stated drawing or model. From this point normal sailmaking procedures are used. The shape is placed into the sail, and the edges outside of the sections 9 and the exterior perimeters of the sail 10, 11, 12 are trimmed and other accessories are added.

In this way the sail maybe more easily assembled than with previous designs. The ability to precut and tape the panels 1 made from cloth of different specifications precludes any more labor intensive techniques.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed new is as follows:

1. A sail comprising a number of pluralities of radial panels, each panel comprising a pair of parallel edges parallel to a longitudinal axis of symmetry of the panel:

each of the pluralities oriented to substantially radiate from a respective attachment means for transferring wind loads to a sailing vessel:

said panels of each plurality oriented and angled to each other to converge near said attachment means, to overlap more of each other near said attachment means, to diverge distant from said attachment means, and to overlap less of each other distant from said attachment means, 2. A sail according to claim 1 in which sail every attachment means for the sail in said sail's un reefed configuration has it's own respective plurality of radial panels.

3. A sail according to claim 1 in which the radial panels are of fabric and most of the fabric panels are substantially free of longitudinal edges on a bias of the fabric.

4. A sail according to claim 1 comprising sections, the radial panels within each section oriented to conform to directions and amounts of stress within the sail.

5. A sail according to claim 1 in which:

each plurality has a respective corner from which the panels of that plurality radiate, each panel has been fabricated from a bolt of sailcloth, said bolt has been manufactured in a relatively consistent width, in which width said bolt was supplied, said bolt width is bounded by a pair of parallel sailcloth edges, each panel having a panel width, and most of the width of each of most panels of the sail comprises an entire bolt width.

6. A sail having:

corners, a perimeter comprising segments between said corners, and an area bounded by said perimeter;

a number of pluralities of radial panels; each plurality having a respective corner from which the panels of that plurality radiate;

each panel having been fabricated from a bolt of sailcloth, said bolt having been manufactured in a relatively consistent bolt width in which width said bolt was supplied, said bolt width bounded by a pair of parallel sailcloth edges, each panel having a panel width and length, the width of each of all the panels comprising an entire bolt width throughout the panel's length, except:

where said panels have longitudinal edges which coincide with the perimeter, and at a low stress miter.

7. A sail according to claim 2 in which panels comprise a fabric of warp and fill yarns and in which said warp yarns are substantially uncut.

8. A sail according to claim 7 substantially without diagonal cuts across the warp and fill.

9. A method of making a sail, said sail having corners, exterior boundaries, and a body, said method comprising steps of:

outlining the corners and edges of the sail's exterior boundaries;

radiating a plurality of panels from each corner, said panels having substantially parallel warp threads and substantially parallel fill threads, each panel having a length and a width, each panel substantially uncut through longitudinal threads along its length except at the panel ends and except where a longitudinal edge coincides with an exterior boundary of the sail;

angling each panel of the plurality with respect to the other panels of the plurality to converge at the plurality's respective corner;

overlapping all converging panels at the respective corner to form a heavy overlap;

diminishing the overlap as the panels diverge away from their respective corner into the body of the sail to form a relatively light body.

10. A method according to claim 9 including the steps of:

dividing the sail into sections, and orienting the panels within each section to conform to directions and amounts of stress within the sail.

11. A method according to claim 9 including the steps of:

attaching the overlapping panels to each other with adhesive.

* * * * *